United States Patent [19]

Gavin

[11] 4,184,597

[45] Jan. 22, 1980

[54] RECLOSABLE DISPENSING CARTON

[76] Inventor: Thomas W. Gavin, 3380 Merrick Rd., Seaford, N.Y. 11783

[21] Appl. No.: 935,775

[22] Filed: Aug. 22, 1978

[51] Int. Cl.[2] ..... B65D 17/20; B65D 17/24

[52] U.S. Cl. ..... 206/611; 206/607; 206/806; 229/36

[58] Field of Search ..... 206/806, 625, 607, 611, 206/624, 626; 209/36, 33

[56] References Cited

U.S. PATENT DOCUMENTS

| | | | |
|---|---|---|---|
| 1,143,103 | 6/1915 | Cameron | 229/33 |
| 2,105,025 | 1/1938 | Curtis | 206/806 |
| 2,973,086 | 2/1961 | Thompson | 206/626 |
| 3,071,304 | 1/1963 | Brastad | 206/626 |
| 3,167,238 | 1/1965 | Smith | 206/625 |

FOREIGN PATENT DOCUMENTS

| | | | |
|---|---|---|---|
| 35515 | 8/1921 | Norway | 206/611 |
| 724849 | 2/1955 | United Kingdom | 229/36 |

*Primary Examiner*—Stephen P. Garbe

*Attorney, Agent, or Firm*—Dennison, Dennison, Meserole & Pollack

[57] ABSTRACT

A folded-blank carton including opposed first and second face walls, opposed first and second side walls, and opposed first and second end walls. At least the first end wall is defined by inner and outer overlying panels, the inner panel being integral with the second face wall along a juncture forming fold line, and the outer panel being integral with the first face wall along a junction forming fold line. The outer panel includes an edge generally aligned over the second face wall and an outwardly projecting tab integral with the outer panel along this edge. A tearout section is defined transversely across the outer panel in alignment with the tab, and a partially severable access section is hinged to the first face wall in alignment with the tearout section for an outward swinging of the tab, tearout section and access section to expose the contents of the carton. The underlying inner panel of the first end wall including a slot therein generally paralleling and immediately adjacent the juncture with the second face wall for close reception of the tab to enable a reclosing of the carton.

7 Claims, 8 Drawing Figures

RECLOSABLE DISPENSING CARTON

BACKGROUND OF THE INVENTION

The invention herein relates to folded cartons, normally constructed from cardboard blanks, and is more particularly concerned with cartons which incorporate, as an integral part thereof, both hanging tabs which provide for a convenient display of the carton, and reclosable dispensing openings for enabling selective access to the contents of the carton. One known example of such a carton or folded box is illustrated in U.S. Pat. No. 3,814,303 to Smith, issued June 4, 1974.

Heretofore, the combination of the above referred to features required a rather elaborate construction utilizing a hanging tab and a reclosable lid as separate and independent components. The additional material required, as well as the manufacturing techniques associated with the relatively complex folding involved could give rise to technological problems as well as questions as to the economical feasibility of utilizing such a carton.

Other examples of the known prior art are as follows:

| | | |
|---|---|---|
| 1,803,736 | SINCLAIR | May 5, 1931 |
| 2,346,488 | HOFFMASTER ET AL | April 11, 1944 |
| 2,467,702 | SMART | April 19, 1949 |
| 3,662,945 | FOSTER ET AL | May 16, 1972 |
| 3,756,502 | SWANSON ET AL | September 4, 1973 |
| 3,904,029 | KOLTZ | September 9, 1975 |

SUMMARY OF THE INVENTION

The present invention proposes a carton wherein the hanging tab is integrally formed with a tearout section extending transversely across the top wall of the carton. This tearout section is in turn integrally formed with a partially severable access section defined in the front wall of the carton for access to the contents thereof. The opening of the carton is simply effected by an upward and forward manual pull on the hanging tab. This results in a severing of the top wall tearout section and a severing of the front wall access panel down to a transverse hinge line. The severed sections, including the hang tab, form what might be considered an outwardly folded flap.

This flap is retained hinged along the lower edge thereof to the front wall so as to also function as a reclosure means for the carton. In effecting the reclosure of the carton, the hanging tab now functions as a locking tab, and as such is received within a slot provided within an inner panel utilized as a portion of the top end wall underlying the tearout section. This slot is provided immediately adjacent the rear face wall so as to reposition the tab substantially in the plane of its original position, thus providing for a maximum closure effect. The use of a narrow slot to reposition the tab tends to lock the tab in position and prevent any outward or opening movement of the flap.

Other objects and advantages will become apparent from the following detailed description of the construction and manner of use of the carton.

DESCRIPTION OF THE PREFERRED EMBODIMENTS

Figure 1:
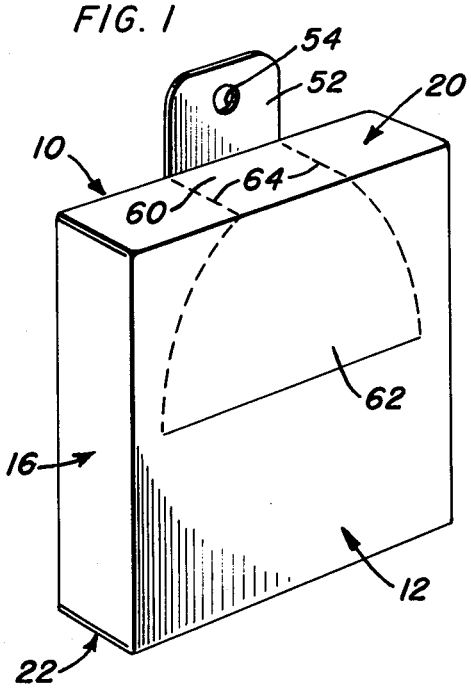
FIG. 1 is a perspective view of the completed and unopened carton.

Referring now more specifically to the drawings, reference numberal 10 designates the folded carton of the present invention. This carton 10 includes front and rear face walls 12 and 14, opposed side walls 16 and 18, and top and bottom walls 20 and 22.

Figure 5:
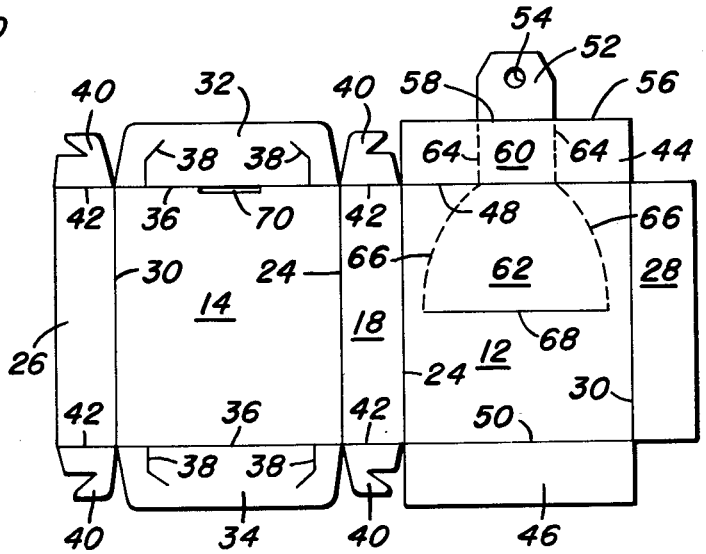
FIG. 5 is a plan view of the blank from which the carton is formed.
Figure 6:
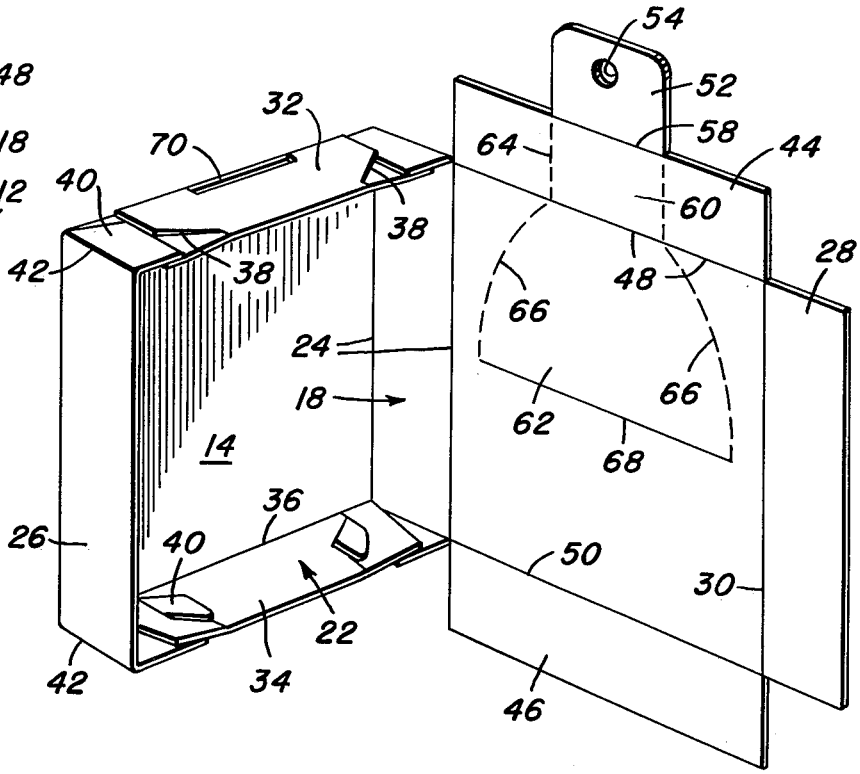
FIG. 6 is a perspective view of the partially folded blank.

Referring specifically to FIGS. 5 and 6, wherein the blank from which the carton 10 is formed has been illustrated, it is to be appreciated that the front and rear face walls 12 and 14 are formed from single panels, designated by the same reference numerals. The side wall 18 is similarly formed from a single panel, also designated 18, and is integral with the two adjoining face walls 12 and 14 along laterally spaced fold lines 24.

The side wall 16 if formed by inner and outer panels 26 and 28 integral along fold lines 30 with the outer edges of the face panels 14 and 12 respectively. These fold lines 30, as will be appreciated, parallel to fold lines 24.

The rear face panel or wall 14 has upper and lower end panels 32 and 34 integrally connected along parallel fold lines 36 to the upper and lower ends of the rear face panel 14. These panels 32 and 34 respectively constitute inner panels of the upper and lower end walls 20 and 22. Each of these end panels 32 and 34 include, toward the opposite ends thereof, transversely extending angled slits 38 which are adapted to recieve upper and lower locking lugs or ears 40. These ears 40 are integrally connected to the opposite ends of the side walls forming panels 18 and 26 along fold lines 42. The hook-like configuration of the lugs 40, in conjunction with the angular slots 38, enable a positive interlock into a basic rectangular configuration, as will be best appreciated from FIG. 6.

The front face wall forming panel 12 is similarly provided with upper and lower end panels 44 and 46 integral with the opposite ends thereof along fold lines respectively designated as 48 and 50. The end panels 44 and 46 respectively constitute outer panels of the upper and lower end walls 20 and 22. These end panels 44 and 46, in the folded carton 10, are recieved over and adhesively affixed to the inner end wall panels 32 and 34 subsequent to a locking of the lugs 40 therewith. At the same time, the outer side wall panel 28 is adhesively secured in overlying relation to the inner side wall panel 26, thus completing the enclosure of the carton.

As will be readily apparent from FIG. 1, the carton 10 is to include an upwardly projecting hanging tab 52 having an aperture 54 therethrough for receiving a suspension hook or the like. This tab 52 is integral with the central portion of the outer edge 56 along fold line 58.

The tab 52 also provides a convenient means for opening the carton for selective access to the contents therein. This is achieved by the provision of aligned readily severable sections 60 and 62 in the outer panel 44 of the top end wall and the upper portion of the front wall forming panel 12. Basically, the section 60, designated as a tearout section, is defined by a pair of laterally spaced tear or weakened lines of separation 64 extending transversely across the top panel 44 paralleling the opposed side edges of the tab 52 in general alignment therewith.

The aligned section 62 in the front face panel 12 constitutes an access panel and is defined by opposed downwardly arcing or arcuately diverging tear or weakened lines of separation 66 which constitute a continuation of the tear lines 54 at the fold line 48. The tear lines extend for approximately one-half the height of the front wall panel 12 with the lower ends thereof interconnected by a transverse hinge line 68. It will of course be appreciated that the height of the access section 62 can vary in accordance with the product to be dispensed from the carton 10.

Figure 2:
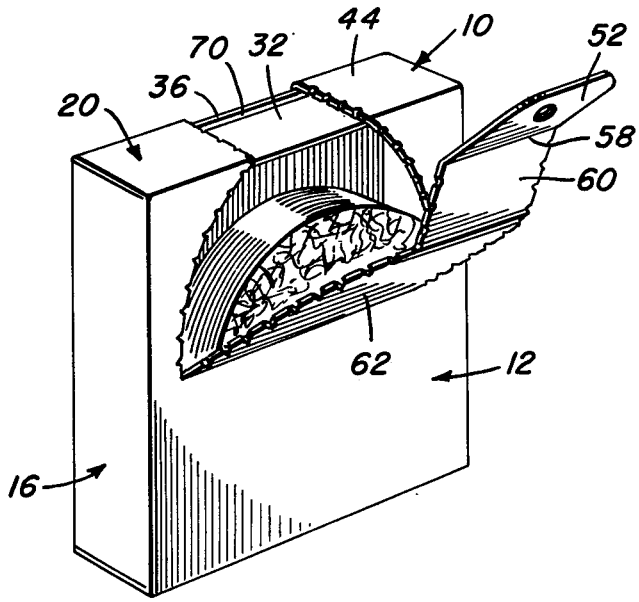
FIG. 2 is a perspective view of the carton opened for access to the contents thereof.

With reference to FIG. 2 in particular, it will be noted that the tab 52, tearout section 60 and access section 62 will pivot outwardly and forwardly in the manner of a large flap for an exposure of the interior of the carton.

Figure 3:
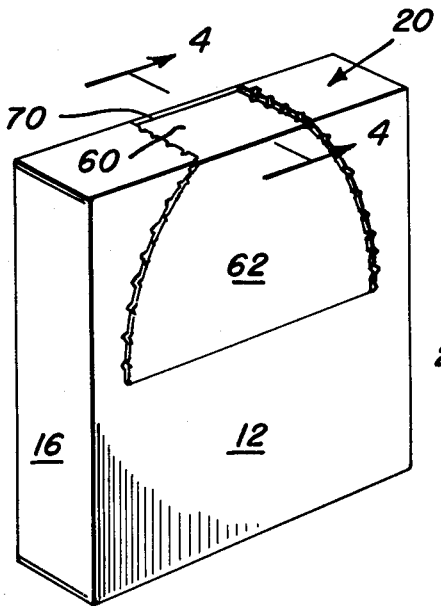
FIG. 3 is a perspective view of the carton with the severed flap reclosed.
Figure 4:
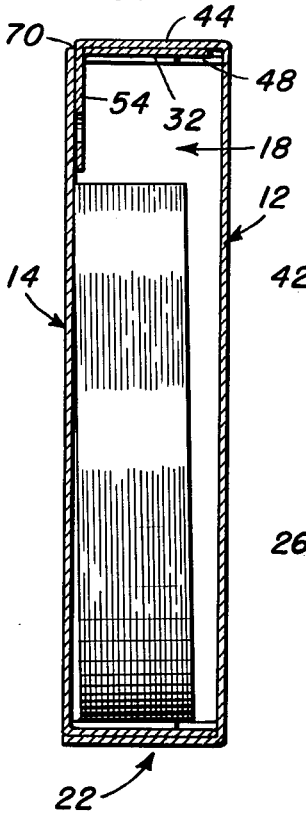
FIG. 4 is a cross-sectional detail taken substantially on the plane passing along line 4—4 in FIG. 3 and illustrating the engagement of the tab.

From the foregoing, it will be appreciated that the tab 52 functions as both a means for hanging and displaying the carton 10, and as a means for facilitating an initial opening of the carton. An additional function of the tab 52 is as a locking tab for use in reclosing the carton. This function is achieved by the provision of a tab receiving slot 70 through the inner panel 32 of the upper end wall 20 immediately at or adjacent the fold line 36 and in substantial alignment with the fold line 58 connecting the tab 52 to the tearout section 60. Thus, as suggested in FIGS. 3 and 4, the flap, or more particularly the sections 60 and 62 can be repositioned and the tab 52 introduced through the slot 70. It is contemplated that the tab 52 be closely received through the slot 70 to provide an effective means for retaining the repositioned sections 60 and 62. Further, so as to facilitate the introduction of the tab 52 through the slot 70, it will be noted that a tapered leading outer end can be provided on the tab. Once engaged within or through the slot 70, the tab 52 can be withdrawn therefrom simply by a grasping of the opposed edges of the overlying tearout section 60 and upwardly pivoting this section so as to withdraw the tab 52 and thus enable a reopening of the carton.

From the foregoing, it will be appreciated that a unique carton has been defined wherein a single panel tab functions as a means for a display hanging of the container and, in conjunction with a pair of aligned tearout sections, as a means for opening the carton for access to the interior thereof. Additionally, the tab uniquely functions as a means for reclosing the container.

Figure 7:
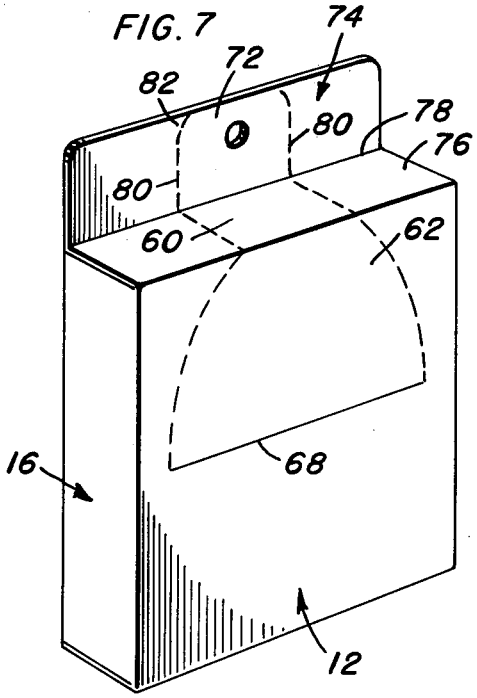
FIG. 7 is a perspective view of another embodiment of the invention.
Figure 8:
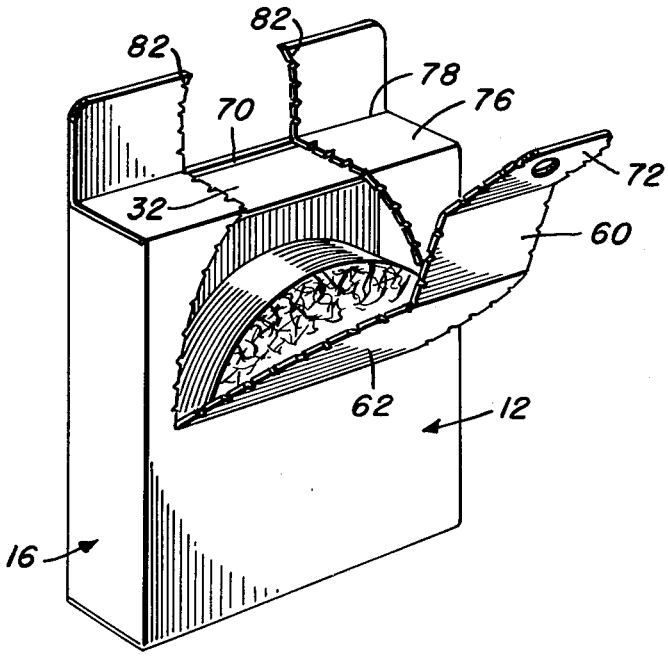
FIG. 8 is a perspective view of the embodiment of FIG. 7 with the flap opened.

With reference particularly to FIGS. 7 and 8, the embodiment illustrated herein differs from that described supra only in providing that the tab, herein designated by reference numeral 72, is a central tearout section within a full length upstanding flange 74. The flange 74 is integral with the top panel 76 along fold line 78 and the tab 72 is defined by a pair of transversely extending tear or weakened lines of separation 80. The remaining features of this embodiment of the invention are the same as those of the initially described embodiment, and like reference numerals have been used to designate like features.

The particular significance of the full length flange 74 is to provide additional rigidity and stability to the carton, particularly at the initial stage when the tab 72 functions as a hanging means. In this connection, and particularly in view of the tapered upper or leading end of the tab 72 and the angled portions 82 of the opposed flange sections which overlie the tab, there is a resistance to a direct upwardly tearing of the tab 72 and a subsequent opening of the flap. In this manner, there is a lesser tendency for the accidental opening of the flap when suspended at a display stand or the like. On the contrary, opening of the embodiment of FIGS. 7 and 8 will normally require an initial forward or rearward flexing of the tab 72 out of the plane of flange 74 prior to an upward and forward drawing thereof so as to strip the tear sections away from the carton.

A reclosing of the embodiment of FIGS. 7 and 8 is effected in the same manner as in the first embodiment by an insertion of the tab 72 into the slot 70 defined in the inner top wall panel 32.

The foregoing is considered illustrative of the principles of the invention. As modifications and changes may occur to those skilled in the art, it is to be appreciated that all such modifications and changes may be resorted to, falling within the scope of the invention as claimed.

I claim:

1. A reclosable carton comprising opposed front and rear walls peripherally interconnected by opposed first and second side walls and opposed first and second end walls, the first end wall including an outer end panel and an underlying inner end panel, said outer end panel having a first edge integral with the front wall and a second edge generally aligned with the rear wall, a projecting panel extension integral with said second edge of the outer end panel, said panel extension comprising an elongated flange positionable outward of the rear wall, said flange having a central tearout section formed therein and constituting a tab, said outer end panel including a tearout section therein extending transversely across said outer end panel in alignment with said tab, said outer end panel tearout section being defined by a pair of spaced tear lines extending transversely across said outer end panel, said front wall including an access section therein, said access section extending from said outer end panel tearout section along at least a portion of the height of the front wall between the opposed end walls, said access section being defined by a pair of spaced divergent tear lines forming continuations of the tear lines across the outer end panel and extending a distance across said front wall corresponding to the height of the access section, a hinge line interconnecting the lower ends of the access section tear lines, said tearout section and said access section being selectively severable from said first end wall and said front wall along said tear lines for a selective exposure of the underlying inner end panel and an opening of the access section to enable access to the interior of the carton, the inner end panel of said first end wall being integrally connected to said rear wall along a fold line at the juncture between the rear wall and the first end wall, and a tab receiving slot defined in the inner end panel of the first end wall parallel to and adjacent said fold line at the juncture between the rear wall and the first end wall, said slot being of a size so as to closely receive said tab for a reclosure of the access section subsequent to an initial opening thereof.

2. In a folded-blank carton, front and rear face panels, said face panels having adjoining side edges and remote side edges, said adjoining side edges being interconnected by a side panel, said front face panel having upper and lower end edges, a top panel joined to said front face panel along the upper end edge thereof, said top panel having an outer edge remote from the upper end edge of the front face panel, and an elongated flange joined to the outer edge of the top panel and projecting outwardly therefrom, a tab joined to the outer edge of the top panel and projecting outwardly therefrom, said tab constituting a central tearout section formed in said flange, a tearout section provided transversely across the top panel aligned with and forming a continuation of said tab, and an access section extending across a portion of said front face panel in alignment with and forming a continuation of the top panel tearout section, said access section having an edge thereof, remote from the top panel tearout section, hinged to said front face panel, said access section having opposed side edges defined by tear lines and being selectively severable from said front face panel, said rear face panel having upper and lower end edges, a top panel joined to the rear face panel along the upper end edge and including an elongated tab receiving slot defined therein parallel to and centrally along the upper end edge of the rear face panel.

3. A reclosable carton comprising opposed front and rear walls peripherally interconnected by opposed first and second side walls and opposed first and second end walls, the first end wall including an outer end panel and an underlying inner end panel, said outer end panel having a first edge integral with the front wall and a second edge generally aligned with the rear wall, a panel extension integral with said second edge of the outer end panel, said panel extension comprising at least a tab generally coplanar with and projecting outward of the rear wall, said tab comprising a hanging tab for suspension of the carton, said outer end panel including a tearout section therein extending transversely across said outer end panel in alignment with said tab, said tearout section being defined by a pair of spaced tear lines extending transversely across said outer end panel, said front wall including an access section therein, said access section extending from said tearout section along at least a portion of the height of the front wall between the opposed end walls, said access section being defined by a pair of spaced tear lines forming continuations of the tear lines across the outer end panel and extending a distance across said front wall corresponding to the height of the access section, a hinge line interconnecting the lower ends of the access section tear lines, said tearout section and said access section being selectively severable from said first end wall and said front wall along said tear lines for a selective exposure of the underlying inner end panel and an opening of the access section to enable access to the interior of the carton, the inner end panel of said first end wall being integrally connected to said rear wall along a fold line at the juncture between the rear wall and the first end wall, and a tab receiving slot defined in said carton parallel to and adjacent said fold line at the juncture between the rear wall and the first end wall, said slot being of a size so as to closely receive said tab for a reclosure of the access section subsequent to an initial opening thereof.

4. The carton of claim 3 wherein said panel extension comprises an elongated flange, said tab constituting a central tearout section formed therein.

5. The carton of claim 3 wherein said side walls and said end walls are substantially narrower than said front and rear walls.

6. The carton of claim 5 wherein said slot is defined in the inner end panel of the first end wall.

7. The carton of claim 6 wherein the tear lines across front panel diverge relative to each other.

* * * * *